US005846900A

United States Patent [19]

Reiter et al.

[11] Patent Number: 5,846,900

[45] Date of Patent: Dec. 8, 1998

[54] COMPOSITE THERMAL DYE TRANSFER ID CARD STOCK

[75] Inventors: Thomas Carl Reiter, Hilton; Peter P. Soscia, Geneseo; David P. Brust, Rochester, all of N.Y.

[73] Assignee: Eastman Kodak Company, Rochester, N.Y.

[21] Appl. No.: 688,975

[22] Filed: Jul. 31, 1996

[51] Int. Cl.[6] ..... B41M 5/035; B41M 5/38

[52] U.S. Cl. ..... 503/227; 428/195; 428/480; 428/910; 428/913; 428/914

[58] Field of Search ..... 8/471; 428/195, 428/480, 913, 914; 503/227

[56] References Cited

U.S. PATENT DOCUMENTS

| | | | |
|---|---|---|---|
| 4,778,782 | 10/1988 | Ito et al. | 503/227 |
| 5,171,625 | 12/1992 | Newton | 428/195 |
| 5,407,893 | 4/1995 | Koshizuka et al. | 503/227 |
| 5,612,283 | 3/1997 | Campbell | 503/227 |

FOREIGN PATENT DOCUMENTS

| | | | |
|---|---|---|---|
| 04-59390 | 2/1992 | Japan | 503/227 |

*Primary Examiner*—Bruce H. Hess
*Attorney, Agent, or Firm*—Harold E. Cole

[57] ABSTRACT

An identification card stock comprising a polymeric core substrate having an oriented polymeric film laminated on at least one side thereof, said card stock also having an image-receiving layer located on the outermost surface of at least one side of said card stock, and process of using same.

19 Claims, No Drawings

COMPOSITE THERMAL DYE TRANSFER ID CARD STOCK

This invention relates to a composite thermal dye transfer identification (ID) card stock, and more particularly to a laminated polyester ID card stock having improved durability and process of using same.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

The use of ID cards has become widespread, especially for driver's licenses, national ID cards, bank and other authority cards, for example. Security is important for such cards, and an important security feature of such cards is the use of a continuous tone color photograph printed in the same layer along with other personal, variable data. This type of information can be rapidly and conveniently placed onto an ID card by use of an electronic camera, a computer, and a computer-controlled digital printer. For example, a video camera or a digital still camera can be used to capture a person's image and a computer can record the corresponding personal, variable data. The image and data can then be printed onto an ID card stock material by a computer-controlled thermal dye transfer printer using the apparatus described in U.S. Pat. No. 4,621,271 referred to above.

The convenience and rapid access of electronically-generated ID cards makes desirable an ID card stock pre-cut to the proper size, readily transportable through a printer, and capable of exiting the printing hardware in the form of a finished card. Off-line lamination after printing and die cutting to size after lamination are undesirable because of the manual labor and time required. A pre-cut ID card which can be printed as is in a thermal printer is known as a "direct printing card".

Poly(vinyl chloride) (PVC) and/or poly(vinyl chloride/acetate), polyesters, polyethylenes and polycarbonates are known for use as ID card materials. PVC-based cards have been the most widely used, but such cards have a short lifetime of only one to two years due to the marginal physical properties of PVC. PVC is also known to readily absorb plasticizers from other objects thereby further degrading its physical properties. Furthermore, PVC-based cards have also shown a tendency to stick to thermal dye-donors during printing at high densities such that on separation from the card, the dye layer of the dye-donor delaminates and sticks to the card.

U.S. Pat. No. 5,171,625 relates to the use of an all polyester composite useful in an ID card. The card comprises a white, opaque poly(ethylene terephthalate) (PET) core with a pair of receiving layers bound to one or both sides of the core material. A clear, biaxially-oriented polyester top film, and optionally a bottom film of the same material, is applied to the outside of the card. A dye image is contained in-between one or both of the pairs of receiving layers.

There is a problem with this card structure, however, in that it is not a direct printing card for use in a thermal printer. After the receiver component is printed, the card must be laminated at an elevated temperature and pressure and then die cut to form the ID card.

U.S. Pat. No. 5,407,893 relates to a composite ID card having a biaxially-oriented polyester core having thereon on both sides a resin film, a writing layer on one side and a thermal dye-receiving layer on the other. The resin layer is either a polyolefin, PVC or an ABS resin.

There is a problem with this card in that only one side is available for thermal printing. Any information, such as a logo, normally printed by non-thermal methods, must be thermally printed at the same time as the picture. There is a further problem with this card in that the preferred dye-receiving layer is PVC which, as mentioned above, can often be subject to dye-donor sticking when high densities are thermally printed.

It is an object of this invention to provide a composite ID card stock and process of using same which is not subject to dye-donor sticking during the printing process. It is another object of this invention to provide a composite ID card stock which has high flexibility and durability over an extended period of time.

These and other objects are achieved in accordance with this invention which comprises an identification card stock comprising a polymeric core substrate having an oriented polymeric film laminated on at least one side thereof, said card stock also having an image-receiving layer located on the outermost surface of at least one side of said card stock.

The ID card structure of the invention is readily suited to making a direct pre-cut card with improved physical properties as compared to PVC-based cards. The ID card stock of the invention provides improved flexural durability over an extended period of time vs. PVC, while retaining good stiffness and impact strength. The ID card material can have layers specifically adapted for thermal printing on both front and back sides, if desired. The card also has separate sites on the polymeric core for printing non-varying information using printing methods other than thermal transfer. The invention also allows one to make use of dye-receiving layers which function well with dye-donors designed to give high maximum density at very short line times without the dye-donor sticking problem encountered with prior art ID cards.

Pre-cut ID card stock can be easily produced by conventional methods using the above-described composite film structure in the conventional shape, size, e.g., 54.5 mm×86 mm, and having a thickness of about 0.8 mm. A pre-cut card stock is one which is made to the card size specifications before printing and exits the printer system without any further trimming or cutting required. An overcoat laminate may be applied after printing if desired.

The thickness of both the polymeric core substrate and oriented polymeric film is variable, but the overall thickness is usually in the range of 685 to 838 $\mu$m (27–33 mils). The outer surfaces of the ID card stock can be thermally printed with dye images or text. Optionally, non-varying information, such as lines, line segments, dots, letters, characters, logos, guilloches, etc., can be printed on the polymeric core substrate by non-thermal dye transfer methods such as flexo or offset printing before attaching the polymeric core substrate to the oriented polymeric film or films carrying the external dye-receiving layer or layers.

The composite ID card stock of the invention can also be readily milled for placement of a memory chip. Alternatively, the polymeric core substrate and an oriented polymeric film can be pre-punched before attaching to provide a suitable site for a memory chip.

The polymeric core substrate employed in the invention can comprise, for example, an amorphous polyester, a biaxially-oriented polyester, poly(vinyl chloride), copolymers of poly(vinyl chloride) with the latter constituting more than 50 mole % of the copolymer, polypropylene, and polypropylene copolymers. In a preferred embodiment of the invention, the polymeric core substrate is an amorphous polyester such as EASTAR® PETG 6763, a copolyester from Eastman Chemical Products Company, that is believed to comprise 16 weight % cyclohexanedimethanol, 34 weight % ethylene glycol, and 50 weight % terephthalic acid, and which has a Tg of 81° C. The polymeric core substrate may also be a composite laminate, such as a laminate of the above materials, if desired. The thickness of the polymeric core substrate can be, for example, from 127 to 787 μm (5–31 mils).

The polymeric core substrate may also include pigments for opacification, such as white pigments, e.g., titanium dioxide, barium sulfate, calcium sulfate, calcium carbonate, zinc oxide, magnesium carbonate, silica, talc, alumina and clay. Suitable pigments may be homogeneous and consist essentially of a single compound such as titanium dioxide or barium sulfate alone. Alternatively, a mixture of materials or compounds can be used along with an additional modifying component such as a soap, surfactant, coupling agent or other modifier to promote or alter the degree to which the pigment is compatible with the substrate polymer.

In general, any pigment employed in the polymeric core substrate has an average particle size of from 0.1 to 1.0 μm, preferably from 0.2 to 0.75 μm. The amount of pigment that is incorporated is generally between about 5% and 50% by weight, preferably about 15 to about 20%, based on the weight of the core polymer.

The polymeric core substrate can be formed by conventional methods such as coating, lamination, co-extrusion and hot-melt extrusion. A preferred method comprises heating a pigmented, amorphous polyester to a temperature above its melting point and continuously melt extruding the material in sheet form through a slot die onto a chilled casting drum, after which it solidifies. The amorphous, opaque sheet may then be cooled and rolled. Such pigmented films are available commercially in various thicknesses.

The oriented polymeric film located on at least one, and preferably on both, outermost sides of the ID card stock of the invention can be, for example, polycarbonates, polyesters such as poly(ethylene naphthalate) and poly(ethylene terephthalate), polyolefins, polyamides, cellulose esters, polystyrene, polysulfonamides, polyethers, polyimides, poly (vinylidene fluoride), polyurethanes, poly(phenylene sulfides), polytetrafluoroethylene, polyacetals, polysulfonates, polyester ionomers, polyolefin ionomers, copolymers and mixtures of the above, etc. In a preferred embodiment of the invention, a synthetic linear polyester is employed. Such a material is well known to those skilled in the art and is obtained by condensing one or more dicarboxylic acids or their lower (up to 6 carbon atoms) diesters, e.g., terephthalic acid, isophthalic acid, phthalic acid, 2,5-, 2,6- or 2,7-naphthalenedicarboxylic acid, succinic acid, sebacic acid, adipic acid, azelaic acid, 4,4'-diphenyldicarboxylic acid, hexahydroterephthalic acid or 2-bis-p-carboxyphenoxyethane (optionally with a monocarboxylic acid, such as pivalic acid), the corresponding dicarboxylic acid dialkyl ester or lower alkyl ester with one or more glycols, e.g., ethylene glycol, 1,3-propanediol, 1,4-butanediol, neopentyl glycol and 1,4-cyclohexanedimethanol. In a preferred embodiment, the polyester polymer is obtained by condensing terephthalic acid or 2,6-naphthalenedicarboxylic acid or their dimethyl esters with ethylene glycol. In another preferred embodiment, the polymer is PET. The PET film prepared from the above-described composition must be oriented. In a preferred embodiment, the PET film is biaxially-oriented. Such a process is described in many patents, such as GB 838,708, the disclosure of which is hereby incorporated by reference. These techniques are well known to those skilled in the art.

The thickness of the oriented polymeric film employed in the invention can be, for example, 19 μm (0.75 mils) to 178 μm (7 mils).

The oriented polymeric film employed in the invention may employ an undercoat or a primer layer on one or both sides to promote adhesion of subsequently coated layers. Undercoat layers which can be used are described in U.S. Pat. Nos. 2,627,088; 2,698,235; 2,698,240; 2,943,937; 3,143,421; 3,201,249; 3,271,178; and 3,501,301, the disclosures of which are hereby incorporated by reference. A preferred material is poly(acrylonitrile-co-vinylidene chloride-co-acrylic acid).

The oriented polymeric film may also have on one side thereof an antistatic layer to avoid accumulation of static charges during high speed coating of the various layers from organic solvents, and to minimize attachment of dirt which can produce defects in subsequent construction of the ID card stock itself. A preferred material is vanadium pentoxide in poly(acrylonitrile-co-vinylidene chloride-co-acrylic acid) as described in U.S. Pat. No. 5,733,845 of Brust, Reiter, and Soscia.

Receiving layer polymers employed in the invention, either on the topside, bottomside, or both sides, include polycarbonates, polyurethanes, polyesters, polyvinyl chlorides, poly(styrene-co-acrylonitrile), polycaprolactone or any other receiver polymer or mixtures thereof. In a preferred embodiment, the receiving layer is a dye image-receiving layer which comprises a polycarbonate. Preferred polycarbonates include bisphenol-A polycarbonates having a number average molecular weight of at least about 25,000. Examples of such polycarbonates include General Electric LEXAN® Polycarbonate Resin, Bayer AG MACROLON 5700®, and the polycarbonates disclosed in U.S. Pat. No. 4,927,803, the disclosure of which is incorporated by reference.

The dye image-receiving layer employed in the invention may be present in any amount which is effective for its intended purposes. In general, good results have been obtained at a receiver layer concentration of from about 1 to about 10 g/m$^2$, preferably from about 0.1 to about 1 g/m$^2$.

Between the dye image-receiving layer and the primed polyester film may be placed other layers such as a compliant or "cushion" layer as disclosed in U.S. Pat. No. 4,734,396, the disclosure of which is hereby incorporated by reference. The function of this layer is to reduce dropouts in the printing process caused by dirt and dust.

The outer oriented polymeric film or films used in the invention, such as PET, may be attached to the polymeric core substrate by extrusion, lamination, extrusion lamination, cold roll lamination, adhesive, etc. If an adhesive is to be used, it is dictated by the nature of the layers on the PET side opposite the dye image-receiver side as well as the material comprising the polymeric core substrate. This adhesive layer can be formed by use of conventional adhesives of the aqueous solution type, emulsion type, solvent type, solvent-less type, solid type, or those in the form of films, tape or webs. The adhesive can be applied to the polymeric core substrate or to the back side layers of the PET film or to both but is preferably only applied to the PET film. The coated adhesive must allow winding and storage of the PET film at moderate temperatures without occurrence of blocking.

In a preferred embodiment, a heat- and pressure-activated, thermoplastic, adhesive is coated from solvent on the back side (opposite from the dye image-receiving layer) of the PET films only. An effective adhesive is one which produces a bond of sufficient strength so that cohesive failure occurs within the PET rather than at the adhesive when an attempt is made to rip apart the composite card.

In such an embodiment, a rectangular sheet of the PET film is placed on each side of a slightly smaller rectangular sheet of the polymeric core material after the adhesive is applied, so that the adhesive is between the polymeric core and the back side of the PET film. The rectangular sheets of the PET films are obtained after coating the adhesive by slitting off a specified amount from each edge of the full width coating, designating one edge as A and the other as B, then slitting the remainder exactly in half in the machine direction of the PET. Rectangular pieces are cut from the slits with the long side corresponding to the long direction of the slit. A composite comprised of rectangular halves of the coated PET film, each half taken from the opposite slit, and the polymeric core substrate are assembled in such a way that the edges A and B of the formerly full width coated PET are superimposed on opposite sides of the polymeric core substrate.

This configuration of the PET slits in the composite promotes flatness of the card stock since areas of the PET support with similar thermal shrinkage behavior are matched on opposite sides of the card. The composite is placed between flat plates, then heat and pressure appropriate for the adhesive are applied for a suitable time. After cooling and removal from the press, the large sheets are cut into strips and fed into a die which cuts cards to the desired dimensions from the strips. The location of die cutting is controlled by sensing black marks pre-printed on the polymeric core material.

In another embodiment of the invention, other features normally used in ID cards may be employed, such as signature panels, magnetic stripes, holographic foils, etc. These features are placed on the composite card at appropriate locations.

Dye-donor elements that are used with the ID card dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving layer on the ID card as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the ID card receiving elements of the invention are available commercially. There can be employed, for example, a Fujitsu Thermal Head (FTP-040 MCS001), a TDK Thermal Head F415 HH7-1089, Kyocera KBE-57-12MGL2 Thermal Print Head or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) an ID card dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. If the ID card stock has dye-receiving layers on both sides, the thermal printing process can then be applied to both sides of the cards.

After the card is thermally imaged, a transparent protective layer can be formed on the surface of the image-receiving layer if desired. This can be done by use of a dye-donor element which includes an additional non-dye patch comprising a transferable protection layer as disclosed in U.S. Pat. Nos. 5,332,713 and 5,387,573, the disclosures of which are incorporated by reference. A protective layer applied in this manner provides protection against image deterioration due to exposure to light, common chemicals, such as grease and oil from fingerprints, and plasticizers often found in items made with poly(vinyl chloride) such as wallets.

A clear, protective layer of equal or greater thickness than that applied from the dye-donor may also be applied to the card using a laminator with heat and pressure. Preferably this protective layer is transferred from a carrier film either in-line or off-line from the thermal printer using a hot roll laminator. Protective layer materials employed are clear thermoplastic polymers whose exact composition is dictated by the ability to adhere to the dye image-receiver layer and to provide the desired, specific protective properties. The protective layer must not degrade the image nor affect image stability to heat and light. Such layer may also incorporate other materials, such as ultraviolet light absorbers. The protective layer may also incorporate security devices such as holographic images.

The following examples are provided to further illustrate the invention.

EXAMPLE 1

A composite card stock of the invention (designated herein as A-1) was prepared in the following manner:

On both sides of a 178 μm thick, transparent, biaxially-oriented PET film was coated a subbing layer of poly (acrylonitrile-co-vinylidene chloride-co-acrylic acid) (14:79:7 wt. ratio) (0.05 g/m$^2$). On one side of the subbed PET were coated the following layers:

1) a compliant layer of a mixture of poly(n-butyl acrylate-co-acrylic acid) (50:50 wt. ratio) (8.1 g/m$^2$), 1,4-butanediol diglycidyl ether (0.57 g/m$^2$), tributylamine (0.32 g/m$^2$), and Fluorad® FC-431 perfluoroamido surfactant (3M Corp.) (0.016 g/m$^2$) from acetone/water solvent;
2) a subbing layer of a mixture of poly(acrylonitrile-co-vinylidene chloride-co-acrylic acid) (14:79:7 wt. ratio) (0.54 g/m$^2$), and DC-1248 surfactant (0.016 g/m$^2$) (Dow Coming Corp.) coated from methyl ethyl ketone;
3) a dye image-receiving layer of a mixture of Makrolon® KL3-1013 polycarbonate, (Bayer AG), (1.78 g/m$^2$), Lexan® 141-112 polycarbonate (General Electric) (1.45 g/m$^2$), dibutyl phthalate, (0.32 g/m$^2$), diphenyl phthalate, (0.32 g/m$^2$), and Fluorad® FC-431 (0.011 g/m$^2$) dissolved in methylene chloride; and
4) an overcoat layer comprising a mixture of a random terpolymer polycarbonate (50 mole % bisphenol A, 49 mole % diethylene glycol, and 1 mole % 2,500 m.w. polydimethylsiloxane block units) (0.22 g/m$^2$), Fluorad® FC-431 and Dow-Corning 510 Silicone Fluid (a mixture of dimethyl and methyl phenyl siloxanes) (0.005 g/m$^2$) dissolved in methylene chloride.

On the opposite side of the PET film was coated an antistatic material on the subbing layer. This antistatic layer is the subject of U.S. Pat. No. 5,733,845 of Brust, Reiter and Soscia, referred to above and comprises vanadium pentoxide in poly(acrylonitrile-co-vinylidene chloride-co-acrylic acid).

Over the antistatic layer was applied a protective coating of Elvacite® 2041 (poly(methyl methacrylate) from DuPont Co.) (1.08 g/m$^2$), matte beads (3–4 μm) of poly(methyl methacrylate-co-ethylene glycol methacrylate) (0.025 g/m$^2$), Fluorad® FC-431 (a surfactant available from 3M Corp.) coated from methylene chloride.

Over the protective coating was applied a heat- and pressure-activated, thermoplastic resin-type adhesive of a terpolymer of vinyl chloride, vinyl acetate and maleic acid (4.1 g/m$^2$) coated from solvent.

A wide coating of the PET film described above was trimmed at the edges and the edges were marked as A and B. The coating was then slit up along its center in the machine direction into two slits each (610 mm) in width. Rectangular pieces were then cut (826 mm) in length from the slits, keeping those pieces having edge A separate from those having edge B.

A piece of the PET film bearing edge A was placed with the adhesive side down on a piece of white, pigmented, amorphous polyester core slightly smaller in size and about 356 μm thick. The amorphous polyester was EASTAR® PETG 6763 (Eastman Chemical Co.). The white pigment in the polyester core was $TiO_2$. A piece of the PET film bearing edge B was placed on the opposite side of the polyester core, with the adhesive side in contact with the polyester core, and edge B was placed so that edge A was superimposed over it. The white polyester sheet was printed before forming the composite to provide marks for controlling the die cutting of the cards from the glued composite.

The composite and the metal plates enclosing the composite were placed in a platen press, then heat (about 110° C.) and pressure (about 17 bar) were applied for about 18 minutes, followed by cooling. After gluing, the composite was slit lengthwise and the strips were cut in a die to produce ID cards ready for thermal printing. The card was made to be 54.5 mm×86 mm and about 737 μm thick following the standard described in ISO/IEC 7810, 2nd Edition, 1995-08-15.

The following commercially available ID cards representative of the state of the art were used as controls:

C-1: PVC card—a three layer composite comprising a thick white PVC core laminated to outer layers of clear PVC with dimensions within the standard cited above for ID cards.

C-2: Surface-modified PVC card—a three-layer composite comprising a thick, white poly(vinyl chloride) core laminated to clear outer layers of a copolymer of vinyl acetate and vinyl chloride containing silicone. This card was designed to show less sticking of dye-donors to the card during thermal printing than a regular PVC card. The card dimensions also conformed to the standard cited above.

The following dyes were used in preparing the dye-donor element used in the experimental work:

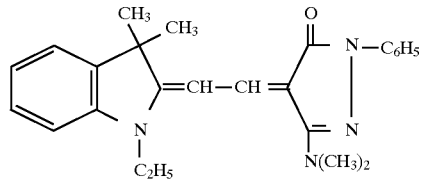

Yellow Dye Y-1

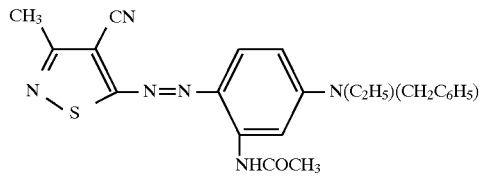

Magenta Dye M-1

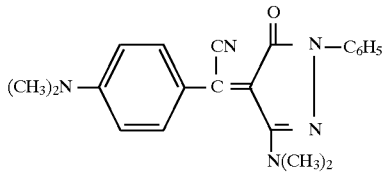

Magenta Dye M-2

-continued

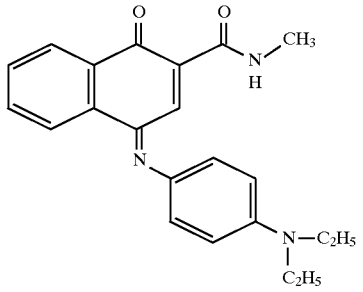

Cyan Dye C-1

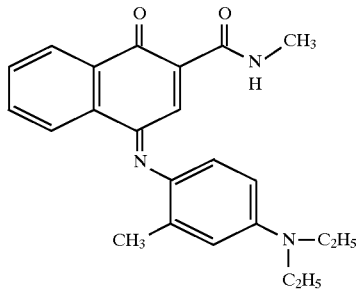

Cyan Dye C-2

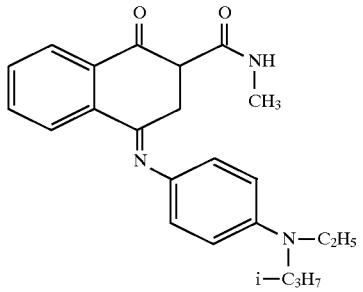

Cyan Dye C-3

A dye-donor element of sequential areas of yellow, magenta and cyan dyes was prepared by coating the following layers, in order, on one side of a 6 μm PET support:

1) a subbing layer of Tyzor® TBT titanium tetra-n-butoxide, (DuPont Corp.) (0.12 g/m$^2$) from a n-propyl acetate and 1-butanol solvent mixture;
2) a dye layer containing sequential, repeating areas of yellow, magenta and cyan dyes as follows:
   a) a yellow area comprising a mixture of yellow dye Y-1 (0.268 g/m$^2$), cellulose acetate propionate (0.359 g/m$^2$), poly (divinylbenzene) 2 μm beads (0.006 g/m$^2$) and Fluorad® FC-430 (0.002 g/m$^2$) coated from a mixture of toluene, methanol and cyclopentanone;
   b) a magenta area comprising a mixture of magenta dye M-1 (0.169 g/m$^2$), magenta dye M-2 (0.184 g/m$^2$), cellulose acetate propionate (0.308 g/m$^2$), 2,3-dihydro-1,1,3-trimethyl-N-(2,4,6-trimethyl-phenyl-3-(4((2,4,6-trimethyl-phenyl)amino)carbonyl) phenyl)-1H-indene-5-carboxamide (0.065 g/m$^2$), poly (divinylbenzene) 2 μm beads (0.006 g/m$^2$) and Fluorad® FC-430 (0.001 g/m$^2$) from a mixture of toluene, methanol and cyclopentanone;
   c) a cyan area comprising a mixture of cyan dye C-1 (0.129 g/m$^2$), cyan dye C-2 (0.117 g/m$^2$), cyan dye C-3 (0.279 g/m$^2$), cellulose acetate propionate (0.299 g/m$^2$), poly(divinylbenzene) 2 μm beads (0.011 g/m$^2$) and Fluorad® FC-430 (0.0005 g/m$^2$) coated from a mixture of toluene, methanol and cyclopentanone.

On the other side of the dye-donor element were coated the same subbing layer as used on the dye side and a slipping layer of KS-1 (a poly(vinyl acetal) from Sekisui Chemical Co.) (0.379 g/m$^2$), PS-513 (an aminopropyl dimethyl-terminated polydimethylsiloxane from United Chemical Technologies, Inc. (0.011 g/m$^2$), p-toluenesulfonic acid (0.0003 g/m$^2$) and candelilla wax particles (Strahl and Pitsch) (0.022 g/m$^2$) coated from diethyl ketone.

Thermal printing of the ID cards described above with the dye-donor was accomplished using a commercial dye transfer thermal printer designed for direct printing of ID cards [Edicon (a Kodak Company) IR-300SN attached to a card hopper Edicon CH-30N]. The dye-donor was used in roll form with color patches 60×111 mm in sequential form.

Seven channels of stepped density neutral images were obtained by printing sequentially the yellow, magenta and cyan patches of the dye-donor on the ID card in an area of 50.8 mm×80.9 mm. The printer operated at about 3 milliseconds line time. The printing of the ID card of the invention (A-1) proceeded smoothly in the printer to give a Status A neutral reflection density of 2.25 at the maximum (Dmax).

After printing, the cards were evaluated for sticking of the dye-donor to the ID card stock. Sticking of the dye-donor to the ID card on peeling off the dye-donor results in non-imagewise transfer of the dye to the ID card. Dye-donor sticking was characterized as:

None—no sticking observed. The dye-donor element separated cleanly from the ID card Slight—partial sticking in one step (usually one of higher density)

Moderate—partial sticking in two steps

Severe—Partial sticking in three or more steps

The following results were obtained:

TABLE 1

| ID Card Stock | Sticking To Dye-Doner |
|---|---|
| C-1 (PVC) | Severe |
| C-2 (modified PVC) | Moderate |
| A-1 (invention) | None |

The data above show the ability of the ID card stock of the invention to be printed at a 3 milliseconds line time in a thermal dye transfer direct card printer to give high printed dye densities without dye donor-to-card sticking. This is in contrast to the objectionable level of sticking to the dye-donor of cards based on PVC typical of the prior art.

EXAMPLE 2

The ID card stock of the invention (A-1) and the PVC-based cards (C-1 and C-2) described above were printed with a portrait image using the printer of Example 1. The printed cards were subsequently laminated at 115° C. in a hot roll laminator on the printed side with a thin, transparent film of poly(methyl methacrylate) from Transfer Print Foils Inc.

The cards were compared for flexural durability using a simple manual test. The cards were creased by bending the card toward the image-bearing side so that the narrow edges touched, then squeezed until a crease was formed. The card was then bent back and forth so that the ends touched. After each bend, the card was squeezed with the thumb and forefinger along the length of the crease. After 25 bends, the cards were visually evaluated for cracking of the card at the crease as follows:

None—no visible cracking in the body of the card

Surface Only—the outer layer of the imaged side cracked but the body of the card was not penetrated Partial Body Cracking—the surface was cracked and the body of the card showed penetration at spots as revealed by transmitted light Total Body Cracking—the card was cracked completely through the body of the card and was almost separated into pieces The following results were obtained:

TABLE 2

| Card Stock | Flexural Durability Cracking |
|---|---|
| C-1 (PVC) | Total body cracking |
| C-2 (modified PVC) | Partial body cracking |
| A-1 (invention) | None |

The above results show that the ID card stock of the invention had superior flexural durability as compared to the prior art PVC-based cards.

The invention has been described in detail with particular reference to preferred embodiments thereof, but it will be understood that variations and modifications can be effected within the spirit and scope of the invention.

What is claimed is:

1. A process of forming a dye transfer image comprising imagewise-heating a dye-donor element comprising a support having thereon a dye layer and transferring a dye image to a dye-receiving element to form said dye transfer image, said dye-receiving element comprising an identification card stock comprising a polymeric core substrate having an oriented poly(ethylene terephthalate) film laminated on at least one side thereof, said card stock also having an image-receiving layer located on the outermost surface of at least one side of said card stock.

2. The process of claim 1 wherein said oriented poly (ethylene terephthalate) film is biaxially-oriented poly (ethylene terephthalate) and which is located on each side of said polymeric core.

3. The process of claim 2 wherein said biaxially-oriented poly(ethylene terephthalate) films are laminated to said polymeric core substrate using an adhesive.

4. The process of claim 2 wherein a dye image-receiving layer is applied to the outermost surface of both of said oriented polymeric films.

5. The process of claim 1 wherein said polymeric core substrate comprises an amorphous polyester.

6. The process of claim 5 wherein said polymeric core substrate also comprises titanium dioxide.

7. A thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises an identification card stock comprising a polymeric core substrate having an oriented poly(ethylene terephthalate) film laminated on at least one side thereof, said card stock also having an image-receiving layer located on the outermost surface of at least one side of said card stock.

8. The assemblage of claim 7 wherein said oriented poly(ethylene terephthalate) film is biaxially-oriented poly (ethylene terephthalate) and which is located on each side of said polymeric core.

9. The assemblage of claim 8 wherein said biaxially-oriented poly(ethylene terephthalate) films are laminated to said polymeric core substrate using an adhesive.

10. The assemblage of claim 8 wherein a dye image-receiving layer is applied to the outermost surface of both of said oriented polymeric films.

11. The assemblage of claim 7 wherein said polymeric core substrate comprises an amorphous polyester.

12. The assemblage of claim 11 wherein said polymeric core substrate also comprises titanium dioxide.

13. An identification card stock comprising a polymeric core substrate having an oriented poly(ethylene terephthalate) film laminated on at least one side thereof, said card stock also having an image-receiving layer located on the outermost surface of at least one side of said card stock.

14. The identification card stock of claim 13 wherein said oriented poly(ethylene terephthalate) film is biaxially-oriented poly(ethylene terephthalate) and which is located on each side of said polymeric core.

15. The identification card stock of claim 14 wherein said biaxially-oriented poly(ethylene terephthalate) films are laminated to said polymeric core substrate using an adhesive.

16. The identification card stock of claim 14 wherein a dye image-receiving layer is applied to the outermost surface of both of said oriented polymeric films.

17. The identification card stock of claim 13 wherein said polymeric core substrate comprises an amorphous polyester.

18. The identification card stock of claim 17 wherein said polymeric core substrate also comprises titanium dioxide.

19. The identification card stock of claim 13 wherein said image-receiving layer contains a thermally-transferred dye image.

* * * * *